US009451657B2

(12) United States Patent
Schilling et al.

(10) Patent No.: US 9,451,657 B2
(45) Date of Patent: Sep. 20, 2016

(54) METHOD FOR HEATING A LIQUID IN A COOKING VESSEL AND INDUCTION HEATING DEVICE

(71) Applicant: E.G.O. Elektro-Gerätebau GmbH, Oberderdingen (DE)

(72) Inventors: Wilfried Schilling, Kraichtal (DE); Christian Egenter, Bretten (DE); Werner Kappes, Neckargerach (DE); Stefan Westrich, Bretten (DE)

(73) Assignee: E.G.O. ELEKTRO-GERÄTEBAU GMBH, Oberderdingen (DE)

( * ) Notice: Subject to any disclaimer, the term of this patent is extended or adjusted under 35 U.S.C. 154(b) by 1030 days.

(21) Appl. No.: 13/627,803

(22) Filed: Sep. 26, 2012

(65) Prior Publication Data

US 2013/0075388 A1 Mar. 28, 2013

(30) Foreign Application Priority Data

Sep. 26, 2011 (DE) ..... 10 2011 083 383

(51) Int. Cl.
*H05B 6/04* (2006.01)
*H05B 6/08* (2006.01)
(Continued)

(52) U.S. Cl.
CPC ..... *H05B 6/062* (2013.01); *H05B 2213/07* (2013.01)

(58) Field of Classification Search
CPC ..... H05B 6/04; H05B 6/06; H05B 6/062; H05B 6/065; H05B 2213/07
USPC ..... 219/620, 621, 626, 627, 660, 661, 667, 219/675
See application file for complete search history.

(56) References Cited

U.S. PATENT DOCUMENTS 6,904,378 B2 6/2005 Schilling et al.
6,995,343 B2 2/2006 Steiner et al.
(Continued)

FOREIGN PATENT DOCUMENTS

DE 102 53 198 6/2004
DE 10 2004 033 115 9/2006
(Continued)

OTHER PUBLICATIONS

Chinese Office Action from Application No. CN 201210459971.3 dated Apr. 21, 2015; 9 pages.
(Continued)

*Primary Examiner* — Hung D Nguyen
(74) *Attorney, Agent, or Firm* — Lee & Hayes, PLLC

(57) ABSTRACT

A method for heating a liquid in a cooking vessel is provided. According to various aspects, an induction heating device includes a resonant circuit having an induction heating coil. A parameter value of the resonant circuit may be determined, depending on a temperature of the cooking vessel. A radio-frequency square-wave voltage may be applied at a predefined heating power setpoint value to the resonant circuit to supply heating power to the cooking vessel. The time profile of the parameter value may be evaluated for determining the boiling point of the liquid. After the boiling point has been determined, the heating power setpoint value may be reduced by a predefined amount over a predefined time period after which a current parameter value may be determined and stored. The parameter value may be adjusted to a setpoint value which is dependent on the stored parameter value.

8 Claims, 1 Drawing Sheet

(51) Int. Cl.
*H05B 6/12* (2006.01)
*H05B 6/06* (2006.01)

(56) References Cited

U.S. PATENT DOCUMENTS

| | | | | |
|---|---|---|---|---|
| 2004/0054486 | A1* | 3/2004 | Schilling | G05D 23/20 99/331 |
| 2008/0203087 | A1* | 8/2008 | Schilling | H05B 6/062 219/600 |
| 2009/0173731 | A1 | 7/2009 | Nagamitsu et al. | |
| 2011/0089156 | A1 | 4/2011 | Santacatterina et al. | |
| 2011/0120989 | A1 | 5/2011 | Schilling et al. | |

FOREIGN PATENT DOCUMENTS

| | | |
|---|---|---|
| JP | H10149875 | 6/1998 |
| JP | 2009-105079 | 5/2009 |

OTHER PUBLICATIONS

European Search Report dated Jun. 17, 2013 in German patent application 12185400.4 (corresponds to U.S. Appl. No. 13/627,799).

European Search Report dated Jun. 14, 2013 in German patent application 12185392.3 (corresponds to U.S. Appl. No. 13/627,807).

European Search Report dated Jun. 14, 2013 in German patent application 12185387.3 (corresponds to U.S. Appl. No. 13/627,803).

German patent application No. DE 10 2011 083 386.2 filed Sep. 26, 2011.

German patent application No. DE 10 2011 083 397.8 filed Sep. 26, 2011.

German Office Action dated May 24, 2012 in DE 10 2011 083 383.8.

German Office Action dated May 29, 2012 in DE 10 2011 083 397.8.

German Office Action dated May 24, 2012 in DE 10 2011 083 386.2.

U.S. Appl. No. 13/627,799, filed Sep. 26, 2012, entitled "Method for Induction Heating and Induction Heating Device", First named inventor: Schilling.

U.S. Appl. No. 13/627,807, filed Sep. 26, 2012, entitled "Method for Heating a Cooking Vessel with an Induction Heating Device and Induction Heating Device", First named inventor: Schilling.

* cited by examiner

METHOD FOR HEATING A LIQUID IN A COOKING VESSEL AND INDUCTION HEATING DEVICE

CROSS REFERENCE TO RELATED APPLICATIONS

This application claims the benefit of German patent application DE 10 2011 083 383.8, filed on Sep. 26, 2011, the contents of which are incorporated by reference for all that it teaches.

FIELD

The invention relates to a method for heating a liquid contained in a cooking vessel utilizing an induction heating device, and to an induction heating device.

BACKGROUND

In induction heating devices, an alternating magnetic field is generated by means of an induction heating coil, the said alternating magnetic field inducing eddy currents in a cooking vessel which is to be heated and has a base which is composed of ferromagnetic material, and creating remagnetization losses, as a result of which the cooking vessel is heated.

The induction heating coil is a constituent part of a resonant circuit which comprises the induction heating coil and one or more capacitors. The induction heating coil is usually designed as a flat, helically wound coil with associated ferrite cores and is arranged, for example, beneath a glass-ceramic surface of an induction hob. In this case, the induction heating coil forms an inductive and a resistive part of the resonant circuit in conjunction with the cookware which is to be heated.

In order to drive or excite the resonant circuit, a low-frequency mains AC voltage with a mains frequency of, for example, 50 Hz or 60 Hz is first rectified and then converted into an excitation or drive signal with a higher frequency by means of semiconductor switches. The excitation signal or the drive voltage is usually a square-wave voltage with a frequency in a range of from 20 kHz to 50 kHz. A circuit for generating the excitation signal is also called a (frequency) converter.

Various methods are known for setting a heating power supply to the cooking vessel as a function of a set heating power setpoint value.

In a first method, a frequency of the excitation signal or of the square-wave voltage is varied as a function of the heating power which is to be output or to be supplied or of the desired power conversion. This method for setting the heating power output makes use of the fact that a maximum heating power is output when the resonant circuit is excited at its resonant frequency. The greater the difference between the frequency of the excitation signal and the resonant frequency of the resonant circuit, the lower is the heating power which is output.

However, if the induction heating device has a plurality of resonant circuits, for example if the induction heating device forms an induction hob with different induction cooking points, and different heating powers are set for the resonant circuits, beats which can lead to interfering noise can be produced by superimposition of the different frequencies of the excitation signals.

One method for setting the heating power which avoids interference noise resulting from such beats is pulse-width modulation of the excitation signal at a constant exciter frequency at which an effective value of a heating power is set by means of varying the pulse width of the excitation signal. However, high switch-on and switch-off currents are produced in the semiconductor switches in the case of effective value control of this kind by varying the pulse width at a constant exciter frequency, as a result of which a broadband and high-energy interference spectrum is produced.

It is often desirable to determine a temperature of a cooking vessel base which is inductively heated in this way, in order to be able to generate, for example, specific heating time profiles, to determine a boiling point and/or to enable automatic cooking functions.

DE 10 2009 047 185 A1, which corresponds to pending U.S. Patent Application No. 2011/0120989, discloses a method and an induction heating device in which temperature-dependent ferromagnetic properties of the cooking vessel base are measured with a high resolution and are evaluated for determining the temperature of the cooking vessel base.

SUMMARY

The disclosure herein provides a method for heating a liquid, which is contained in a cooking vessel, utilizing an induction heating device, and a corresponding induction heating device. According to various aspects, a parameter value of a resonant circuit of an induction heating device may be determined. The parameter value may include a period duration of a naturally resonant oscillation of the resonant circuit and may depend on the temperature of a base of a cooking vessel. A radio-frequency square-wave voltage may be applied to the resonant circuit, supplying a heating power to the base of the cooking vessel at a heating power setpoint value. A time profile of the parameter value may be evaluated for determining the boiling point of the liquid. After the boiling point has been determined, the heating power setpoint value may be reduced by a predefined amount over a predefined time period. After the predefined time period has elapsed, a current parameter value may be determined and stored, and the parameter value adjusted to a setpoint value which is dependent on the stored parameter value.

BRIEF DESCRIPTION OF THE DRAWINGS

The disclosure will be described below with reference to the drawings which show preferred embodiments. In the drawings.

DETAILED DESCRIPTION

Figure 1:
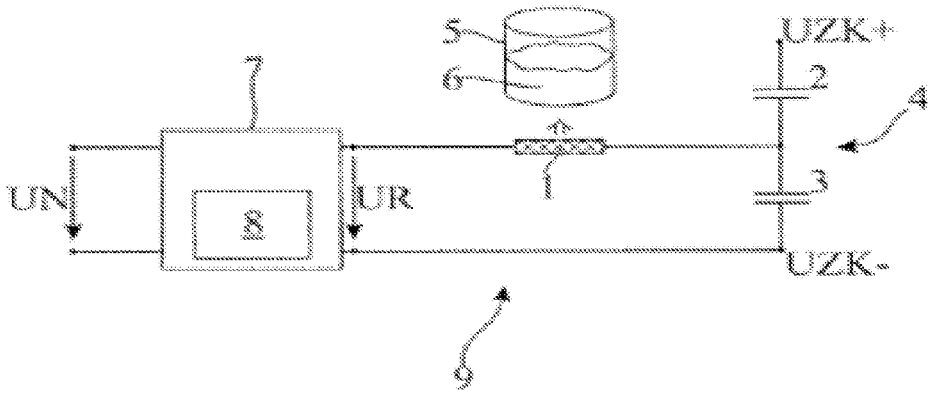
FIG. 1 schematically shows an induction heating device having a resonant circuit which has an induction heating coil, and having a control device, and FIG. 2 schematically shows a time profile of a temperature of water in a cooking vessel, which water is heated by means of the induction heating device which is illustrated in FIG. 1, a time profile of a heating power supplied to the cooking vessel by means of the induction heating device, and a time profile of a period duration of a naturally resonant oscillation of the resonant circuit.

The disclosure herein provides a method for heating a liquid, which is contained in a cooking vessel, by means of an induction heating device, and provides an induction heating device for carrying out the method. These aspects enable boiling to be performed in a temperature-controlled manner, in particular on the basis of the measurement principle disclosed in DE 10 2009 047 185 A1, which corresponds to pending U.S. Patent Application No. 2011/0120989.

The disclosure herein may be used for heating and continuing to boil a liquid, for example water, which is contained in a cooking vessel, by means of an induction heating device, wherein the induction heating device may include a resonant circuit having an induction heating coil. A method described herein may include continuously or periodically determining at least one parameter value of the resonant circuit. In particular, the parameter value may include a natural resonant frequency of the resonant circuit or a period duration which belongs to the natural resonant frequency, which may be dependent on a temperature of the cooking vessel base, in particular as described in DE 10 2009 047 185 A1, which corresponds to pending U.S. Patent Application No. 2011/0120989.

A drive signal may be applied in the form of a radio-frequency square-wave voltage to the resonant circuit for the purpose of supplying heating power to the cooking vessel base, at a predefined heating power setpoint value, in particular a maximum heating power setpoint value. The application of the radio-frequency square-wave voltage to the resonant circuit may be preferably briefly interrupted, in particular in the region of a zero crossing of a mains AC voltage, during the process of determining the at least one parameter value. The time profile of the at least one parameter value may be evaluated, or a time profile of a variable which is derived from the parameter value may be evaluated, for determining the boiling point of the liquid. For example, a change in the at least one parameter value or the derived variable being determined may establish the boiling point when the change falls below or exceeds, in particular falls below, a predefined value.

After the boiling point has been determined, the heating power setpoint value may be reduced by a predefined amount over a predefined time period. After, in particular immediately after, the predefined time period has elapsed, a current parameter value may be determined and stored. The at least one parameter value may be adjusted to a setpoint value which is dependent on the stored parameter value, wherein conventional heating-power-determining variables can be used as the actuating variable, for example a frequency of the square-wave voltage and/or a pulse width or a pulse duty factor of the square-wave voltage. According to various embodiments, a parameter setpoint value of this kind may be consequently determined in an automated manner, the said parameter setpoint value enabling continued boiling with an optimum continued boiling stage since the parameter value which is set after the boiling point is identified is ideally suitable for calculating the setpoint value.

In a development, the predefined time period may lie in a range of between one second and 50 seconds, preferably between three seconds and 20 seconds. In a development, the predefined amount by which the heating power setpoint value is reduced over the predefined time period may be determined as a function of a set continued boiling stage, in particular in such a way that, in the case of a relatively high continued boiling stage, the heating power setpoint value over the predefined time period is reduced by a smaller amount compared with a relatively low continued boiling stage.

In a development, the setpoint value of the parameter value may be equal to the stored parameter value. In a development, the heating power setpoint value may be reduced to 10% to 50% of the maximum heating power setpoint value over the predefined time period. In a development, an offset may be subtracted from the stored parameter value in order to determine the setpoint value of the parameter value, wherein the smaller a set continued boiling stage, the greater is the offset.

In a development, the abovementioned steps may be followed by evaluating the time profile of the parameter value or of a variable which is derived from the parameter value, for example derived by forming a reciprocal when the parameter value or the variable which is derived from the parameter value changes by more than a maximum amount with a monitoring time interval, for example on account of the introduction of a product to be cooked into the liquid; adjusting the heating power setpoint value to a setpoint value for a recipe which is being followed, and repeating steps c) to g). If the parameter value or the derived variable changes within the monitoring time interval by less than the maximum amount, the liquid can be gently reheated using the previously ascertained setpoint value as a guide variable, for example for a PI controller. In this way, the product to be cooked can be introduced, this having a severe cooling effect on the liquid, in an optimum manner since rapidly re-heating and then continued boiling can be performed immediately.

Turning now to the drawings, FIG. 1 schematically shows an induction heating device 9 having a resonant circuit 4 which has an induction heating coil 1 and capacitors 2 and 3, and a power unit 7 which rectifies a low-frequency mains AC voltage UN with a mains frequency of, for example, 50 Hz in a conventional manner and controlled by a control device 8, and then converts the said voltage UN into a square-wave voltage UR with a frequency in a range of from 20 kHz to 50 kHz by means of semiconductor switches (not illustrated), wherein the square-wave voltage UR is applied to the resonant circuit 4 or its induction heating coil 1 in order to supply heating power to a ferromagnetic base of a cooking vessel 5.

The capacitors 2 and 3 are conventionally looped in series between poles UZK+ and UZK− of an intermediate circuit voltage, wherein a connection node of the capacitors 2 and 3 is connected to a connection of the induction heating coil 1.

The induction heating device 9 has a measurement means (not illustrated in any more detail) which enables continuous or periodic determination of a parameter value of the resonant circuit 4 in the form of a period duration Tp (see FIG. 2) of a naturally resonant oscillation of the resonant circuit 4, wherein the period duration Tp is dependent on the temperature of the cooking vessel base, that is to say likewise increases as the temperature increases, since the effective inductance increases as the temperature of the cooking vessel base increases, and therefore the resonant frequency decreases and the period duration correspondingly increases. The period duration Tp can be determined, for example, by means of a timer of a microcontroller.

Reference may also be made to DE 10 2009 047 185 A1 in respect of the design and basic function of the measurement means, the measurement method and the heating power setting, said document hereby being included in the content of the description by reference in this respect in order to avoid repetition.

Figure 2:
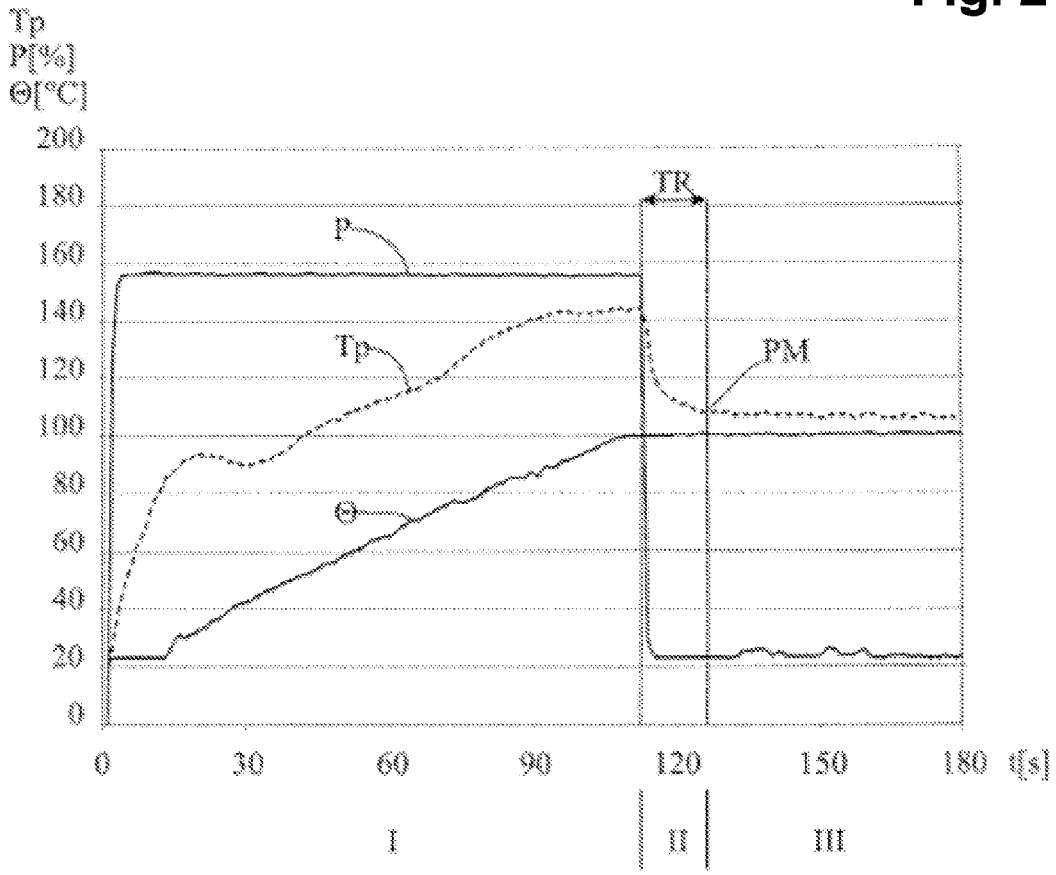

FIG. 2 shows a time profile of a temperature Θ of water 6 in the cooking vessel or pot 5 which is heated by means of the induction heating device 9 which is illustrated in FIG. 1, a time profile of a heating power P (in % of a rated heating power) which is supplied to the cooking vessel 5 by means of the induction heating device, and a time profile of the period duration Tp of a naturally resonant oscillation of the resonant circuit 4 when the method according to the disclosure for heating and continued boiling is carried out.

The control device 8 continuously and periodically determines the period duration Tp of a naturally resonant oscillation of the resonant circuit 4, wherein, to this end, the heating power supply is briefly interrupted and a changeover is made to naturally resonant operation of the resonant circuit 4. These phases are not shown in FIG. 2 on account of the low time resolution.

In a time interval I, the radio-frequency square-wave voltage UR is applied to the resonant circuit 4 at a maximum heating power setpoint value in order to boil the water 6 as rapidly as possible. The maximum heating power setpoint value as the so-called boost is approximately 1.6 times the rated heating power.

The control device 8 evaluates the time profile of the period duration Tp for determining the boiling point. At the end of the time interval I, the increase in the period duration Tp decreases to below a predefined minimum value, this suggesting that the water 6 is boiling. A brief decrease in the period duration Tp at the start of the time interval I is inherent to its functional principle and is not assessed by the control device 8 as indicating boiling.

In a subsequent time interval II, the heating power setpoint value is reduced by a predefined amount over a predefined time period TR of approximately 20 seconds, wherein the predefined amount is determined as a function of a continued boiling stage which is selected by a user.

In time interval II, the water temperature Θ decreases only slightly on account of the high thermal capacity of water, whereas the pot base temperature, represented by the period duration Tp, decreases down to a value PM which is stored in the control device 8 and which corresponds to a desired continued boiling power as a guide variable.

In a subsequent time interval III, the period duration Tp is adjusted to the stored parameter value PM by suitable heating power supply.

After automatic identification of the boiling point, more or less powerful continued boiling is usually desired. The intensity of the continued boiling depends on the heating power which is supplied to the pot 5. Different, so-called "wall degrees" can be achieved by supplying different heating powers.

To this end, the induction heating device 9 provides a plurality of selectable continued boiling stages, for example 9 different continued boiling stages.

Stages 1 and 2 are provided for simmering at temperatures of between 75° C. and 95° C. Temperature control or control of the period duration Tp which corresponds to temperature control of the pot base is accordingly employed here. The guide variable PM for the temperature controller is derived from the boiling point. To this end, after the boiling point is identified, the power can be reduced to approximately 10% to 20% of the rated or maximum power and, after approximately 3 seconds to 20 seconds, the current measurement value PM of the period duration, not in the same way as shown in FIG. 2, minus an offset which corresponds to approximately 15 K in stage 1 and corresponds to approximately 5 K in stage 2, is adopted as the guide variable for the temperature controller or period duration controller.

Stages 3-9 are assigned minimum continued boiling powers which must not be undershot and can be selected by the user depending on the desired wall degree.

For continuing the boiling process, it is beneficial when the continued boiling state is also maintained or rapidly reached again even after food has been added, without the user having to take any action. This is ensured, as shown in FIG. 2, by the heating power being reduced to a value corresponding to the selected continued boiling stage after the boiling point is detected, and the measured value PM of the period duration Tp being adopted as the setpoint value after a settling time of a few seconds, for example 3 to 20 seconds. The pot base temperature can now be adjusted to this setpoint value, wherein the minimum heating power cannot drop below the value of the setpoint heating power for the selected wall degree in accordance with the continued boiling stage.

When food is added, the temperature which is detected at the pot base and can be used for subsequent heating generally drops. Depending on the type of dish, different subsequent heating strategies can be used. Therefore, gentle subsequent heating should be selected for food with a high tendency to froth, while powerful subsequent heating can be applied for food with no tendency to froth.

The addition of food can cause changes in the boiling temperature. This can be detected by a higher or lower temperature than the setpoint temperature (boiling temperature measured at the beginning) being established at a rated continued boiling power. In this case, the setpoint temperature is corrected.

The pot base temperature reduces immediately after the addition of food on account of heat being drawn by the food. Depending on the type and quantity of food, a smaller or larger temperature jump is produced. Depending on the magnitude and speed of the temperature jump different subsequent heating strategies can be applied according to the disclosure. For example, more than 3 K in less than 10 s leads to powerful, constant subsequent heating at a high power (>75%) until boiling is identified again and the powerful subsequent heating is terminated.

Smaller drops in temperature lead to gentle subsequent heating with the previously detected setpoint variable as the guide variable, for example for a PI controller.

It goes without saying that, instead of the parameter value of the resonant circuit in the form of the period duration, other/additional parameter values can also be used, for example an amplitude of a resonant circuit voltage, a voltage across the induction heating coil, an amplitude of a resonant circuit current and/or a phase shift between the resonant circuit voltage and the resonant circuit current.

It also goes without saying that the disclosure herein can also be used in the context of a parallel resonant circuit or a series resonant circuit with full-bridge driving.

The invention claimed is:

1. A method for heating a liquid, which is contained in a cooking vessel, utilizing an induction heating device, the method comprising:

continuously determining a parameter value of a resonant circuit of the induction heating device, the resonant circuit comprising an induction heating coil, wherein the parameter value comprises a period duration of a naturally resonant oscillation of the resonant circuit, and wherein the parameter value depends on a temperature of a base of the cooking vessel;

applying a radio-frequency square-wave voltage to the resonant circuit such that a heating power is supplied to the base of the cooking vessel at a heating power setpoint value;

evaluating a time profile of the parameter value to determine a boiling point of the liquid;

after the boiling point of the liquid has been determined, reducing the heating power setpoint value by a predefined amount over a predefined time period, wherein the predefined amount being reduced to a range of 10% to 50% of a maximum heating power setpoint value;

after the predefined time period has elapsed, determining and storing a current parameter value; and adjusting the heating power setpoint value based on the stored current parameter value.

2. The method of claim 1, wherein the predefined time period lies in a range of one second to 30 seconds.

3. The method of claim 1, wherein the predefined amount by which the heating power setpoint value is reduced over the predefined time period is determined as a function of a set continued boiling stage.

4. The method of claim 3, wherein an offset value is subtracted from the stored current parameter value in order to determine the reduced heating power setpoint value, wherein the smaller the value of the set continued boiling stage, the greater the offset value.

5. The method of claim 1, wherein the heating power setpoint value is equal to the stored current parameter value.

6. The method of claim 1, further comprising:

further evaluating the time profile of the parameter value; and when the parameter value changes by more than a maximum amount within a monitoring time interval:

adjusting the heating power setpoint value to another heating power setpoint value for a recipe which is being followed;

further evaluating the time profile of the parameter value for determining the boiling point of the liquid;

after the boiling point of the liquid has been further determined, reducing the other heating power setpoint value by another predefined amount over another predefined time period;

after the other predefined time period has elapsed, determining and storing another current parameter value; and adjusting the parameter value to a heating power setpoint value which is dependent on the stored other current parameter value.

7. An induction heating device, comprising:

a resonant circuit comprising an induction heating coil; and a control device configured to continuously determine a parameter value of the resonant circuit of the induction heating device, wherein the parameter value comprises a period duration of a naturally resonant oscillation of the resonant circuit, and wherein the parameter value depends on a temperature of a base of a cooking vessel, apply a radio-frequency square-wave voltage to the resonant circuit such that a heating power is supplied to the base of the cooking vessel at a heating power setpoint value, evaluate a time profile of the parameter value for determining a boiling point of liquid in the cooking vessel, after the boiling point of the liquid has been determined, reduce the heating power setpoint value by a predefined amount over a predefined time period, wherein the predefined amount being reduced to a range of 10% to 50% of a maximum heating power setpoint value, after the predefined time period has elapsed, determine and store a current parameter value, and adjust the heating power setpoint value based on the stored current parameter value.

8. A method for heating a liquid, which is contained in a cooking vessel, utilizing an induction heating device, the method comprising:

continuously determining a parameter value of a resonant circuit of the induction heating device, the resonant circuit comprising an induction heating coil, wherein the parameter value comprises a period duration of a naturally resonant oscillation of the resonant circuit, and wherein the parameter value depends on a temperature of a base of the cooking vessel;

applying a radio-frequency square-wave voltage to the resonant circuit such that a heating power is supplied to the base of the cooking vessel at a heating power setpoint value;

evaluating a time profile of the parameter value to determine a boiling point of the liquid;

after the boiling point of the liquid has been determined, reducing the heating power setpoint value by a predefined amount over a predefined time period;

after the predefined time period has elapsed, determining and storing a current parameter value;

adjusting the heating power setpoint value based on the stored current parameter value;

further evaluating the time profile of the parameter value;

determining when the parameter value changes by more than a maximum amount within a monitoring time interval;

based on determining when the parameter value changes by more than the maximum amount, adjusting the heating power setpoint value to another heating power setpoint value for a recipe which is being followed;

further evaluating the time profile of the parameter value for determining the boiling point of the liquid;

after the boiling point of the liquid has been further determined, reducing the other heating power setpoint value by another predefined amount over another predefined time period;

after the other predefined time period has elapsed, determining and storing another current parameter value; and adjusting the parameter value to a heating power setpoint value which is dependent on the stored other current parameter value.

* * * * *